United States Patent [19]

Wilburn et al.

[11] Patent Number: 4,844,829

[45] Date of Patent: Jul. 4, 1989

[54] METHACRYLATE POUR POINT DEPRESSANTS AND COMPOSITIONS

[75] Inventors: Bruce E. Wilburn; William J. Heilman, both of Houston, Tex.

[73] Assignee: Pennzoil Products Company, Houston, Tex.

[21] Appl. No.: 257,175

[22] Filed: Oct. 13, 1988

Related U.S. Application Data

[63] Continuation of Ser. No. 87,035, Aug. 19, 1987, abandoned.

[51] Int. Cl.[4] ..... C10M 107/20

[52] U.S. Cl. ..... 252/56 R; 252/52 R

[58] Field of Search ..... 252/56 R, 565, 56 D

[56] References Cited

U.S. PATENT DOCUMENTS

| | | | |
|---|---|---|---|
| 2,091,627 | 8/1937 | Bruson . | |
| 2,544,376 | 3/1951 | Butler . | |
| 2,655,479 | 10/1953 | Munday . | |
| 3,417,021 | 12/1968 | Engelhart . | |
| 3,507,932 | 4/1970 | Morduchowitz et al. . | |
| 3,598,736 | 8/1971 | Van der Meij et al. . | |
| 3,598,737 | 8/1971 | Van der Meij et al. . | |
| 3,607,749 | 9/1971 | Forbes . | |
| 3,679,644 | 7/1972 | Van der Meij et al. . | |
| 3,814,690 | 6/1974 | Song et al. | 252/56 D |
| 3,864,099 | 2/1975 | Ek . | |
| 3,869,396 | 3/1975 | Van de Kraats et al. . | |
| 3,892,671 | 7/1975 | Song et al. . | |
| 3,897,353 | 7/1975 | Morduchowitz | 252/56 R X |
| 4,021,357 | 5/1977 | Morduchowitz et al. . | |
| 4,045,376 | 8/1977 | Rubin | 252/56 R X |
| 4,073,738 | 2/1978 | Ladenberger et al. . | |
| 4,088,589 | 5/1978 | Rossi | 252/56 R |
| 4,146,492 | 3/1979 | Cusano et al. . | |
| 4,149,984 | 4/1979 | Wenzel et al. . | |
| 4,203,854 | 5/1980 | Silverstein . | |
| 4,290,925 | 9/1981 | Pennewiss | 252/56 R X |
| 4,533,482 | 8/1985 | Bollinger . | |
| 4,606,834 | 8/1986 | Hart et al. . | |

FOREIGN PATENT DOCUMENTS

| | | |
|---|---|---|
| 3339103 | 9/1985 | Fed. Rep. of Germany . |
| 1559952 | 1/1980 | United Kingdom . |

OTHER PUBLICATIONS

Gavlin et al, "Pour Point Depression of Lubricating Oils", *Industrial and Engineering Chemistry,* vol. 45, 1953, pp. 2327 to 2335.

Clevenger et al, "Low Temperature Rheology of Multigrade Engine Oils—Formulary Effects", 1983 Society of Automotive Engineers, Inc., Publication No. 831716.

Henderson et al "New Mini-Rotary Viscometer Temperature Profiles that Predict Engine Oil Pumpability", Society of Automotive Engineers, Inc. 1985, Document No. 850443.

Lorensen, "Symposium on Polymers in Lubricating Oil" Presented Before the Division of Petroleum Chemistry, American Chemical Society, Atlantic City Meeting, Sep. 9-14, 1962, Preprint, vol. 7, No. 4.

R. L. Stambaugh "Low Temperature Pumpability of Engine Oils", Society of Automotive Engineers, Document No. 841388, 1984.

Rohm GmbH sales publication for Viscoplex Series.

*Primary Examiner*—William R. Dixon, Jr.

*Assistant Examiner*—James M. Hunter, Jr.

*Attorney, Agent, or Firm*—Lowe, Price, LeBlanc, Becker & Shur

[57] ABSTRACT

A pour point depressant for lubricating oils comprises a poly(methacrylate) polymer having the repeating unit wherein R is an alkyl group having an average chain length in the polymer of 12.6 to 13.0, and n is an integer indicating the number of repeating units, the value of n being sufficient to provide a molecular weight of 10,000 to 300,000 for the polymer, the pour point depressant having the capacity to reduce the stable pour point to −35° C., while being compatible with other additives such as viscosity index improvers.

21 Claims, 4 Drawing Sheets

METHACRYLATE POUR POINT DEPRESSANTS AND COMPOSITIONS

This application is a continuation of application Ser. No. 087,035, filed Aug. 17, 1987 now abandoned.

FIELD OF THE INVENTION

This invention relates to pour point depressants for use in lubricating oils and more particularly to a new and novel class of poly(methacrylate) polymeric pour point depressants which provide substantial advantages when used in lubricating oils.

BACKGROUND

Wax-bearing lubricating oils are known to set to a semi-plastic mass on cooling below the temperature of the crystallization point of the wax contained in the lubricating oil. This change is measured in terms of pour point which may be defined as the temperature at which the oil sample is no longer considered to flow when subjected to the standardized schedule of quiescent cooling prescribed by ASTM D97-47. This problem presents a substantial disadvantage in the use of lubricating oils by the petroleum industry.

The problem with lubricating oils which contain any amount of waxes is that the wax contained in the oil, which is a paraffinic oil, will crystallize when the oil is cooled, and networks of wax crystals will then form on further cooling which will prevent the oil from flowing. The point at which the oil stops flowing is defined as the pour point temperature. Dewaxing of an oil improves the pour point, but this is an expensive procedure. Usually, the procedure is to dewax an oil to a certain temperature and then add pour point depressants to improve the low temperature properties. However, at the lower temperature, the same amount of wax will still separate. The pour point depressants do not make the wax more soluble in oil; they function rather by disrupting or preventing the formation of the waxy network. As little as 0.2 wt. % of a good pour point depressant can lower the pour point of the paraffinic oil or lubricating composition by 30°-35° C.

The wax networks will also lead to an increase in oil viscosity. The increase in viscosity is generally temporary as a "normal" internal combustion engine can generate sufficient shear to disrupt the wax networks and allow the oil to flow. However, it should be emphasized that while the physical turning or cranking of the engine is usually unimpeded, the temporary disruption in the oil flow can lead to an increase in bearing wear.

Studies have indicated that the amount of wax needed to prevent flow or gel for an oil is quite small. Approximately 2% precipitated wax will gel middle distillates, and a similar amount is needed for lubricating oils.

Many different types of pour point depressants have been used in the prior art. Previously used pour point depressants are predominantly oligomers having molecular weights of 1,000 to 10,000, or polymers which have molecular weights greater than 10,000. The early point depressants were either alkylated aromatic polymers or comb polymers. Comb polymers characteristically have long alkyl chains attached to the backbone of the polymer, with the alkyl groups being of different carbon chain lengths.

The mechanism of action for pour point depressants has been the subject of much interest. Early indications were that alkylated aromatic compounds function as pour point depressants by coating the surface of the wax crystals and preventing further growth. More recently, however, it appears that the pour point depressants are either absorbed into the face of the wax crystal if the pour point depressant is an alkyl aromatic or co-crystallize with the wax crystal if it is comb polymer. Thus, crystal growth is not prohibited, it is simply directed or channeled along different routes. Light microscopy suggests that wax crystals are typically thin plates or blades, and when a pour point depressant is added to the system, those crystals are smaller and more branched, and thus the pour point depressant may disrupt or redirect crystal growth from different directions into a single direction, and bulkier crystals will be formed. These crystals then can form networks only at much lower temperatures which results in a lower pour point.

Reports on pour points studies may be found in the publication by Gavlin et al entitled "Pour Point Depression of Lubricating Oils", *Industrial and Engineering Chemistry,* Vol. 45, 1953, pages 2327 to 2335. Also of interest in background with respect to pour point depressants is the publication by Clevenger et al, entitled "Low Temperature Rheology of Multigrade Engine Oils-Formulary Effects", 1983 Society of Automotive Engineers, Inc., Publication No. 831716; a publication by Henderson et al entitled "New MiniRotary Viscometer Temperature Profiles that Predict Engine Oil Pumpability", Society of Automotive Engineers, Inc. 1985, Document No. 850443; a publication by Lorensen, "Symposium on Polymers in Lubricating Oil Presented Before the Division of Petroleum Chemistry, American Chemical Society, Atlantic City Meeting, Sept. 9-14, 1962, Preprint, Vol. 7, No. 4; and a publication by R. L. Stambaugh entitled "Low Temperature Pumpability of Engine Oils", Society of Automotive Engineers, Document No. 841388, 1984.

As pointed out above, the most recent interest in pour point depressants is found in poly(methacrylate) polymers. Indeed, methacrylate/acrylate polymers appear to be the most popular class of pour point depressants now in use. There is available commercially a line of poly(methacrylate) pour point depressants from the Rohm and Haas Company under the tradename Acryloid. Also available are similar products from Texaco under a trade designation of TLA followed by a numerical suffix or TC followed by a numerical suffix.

There has also been substantial patent activity concerned with pour point depressants which comprise poly(methacrylate) compositions. Thus U.S. Pat. Nos. 3,607,749 and 4,203,854 disclose poly(methacrylate) as viscosity index improvers, but without any data as to their low temperature performance. In particular, U.S. Pat. No. 3,607,749 discloses a blend of a high molecular weight polymethacrylate with a low molecular weight polymethacrylate as a viscosity index improver.

U.S. Pat. No. 3,598,736 discloses the addition of small amounts of oil soluble polymethacrylates to lubricating oils to reduce the pour point. The polyalkylmethacrylates are described as copolymers wherein the alkyl side chain contains from 10 to 20 carbon atoms with an average of between 13.8 and 14.8 carbon atoms. U.S. Pat. No. 3,679,644 is a division of U.S. Pat. No. 3,598,736 and contains the same disclosure.

U.S. Pat. No. 4,073,738 discloses the use of a pour point depressant which comprises an alkyl acrylate or alkyl methacrylate wherein the alkyl group side chain can have from 8 to 30 carbon atoms and preferably from 8 to 22 carbon atoms.

U.S. Pat. No. 4,088,589 discloses a combination of pour point depressants of which one can be an oil soluble polymer of an alkyl acrylate or methacrylate which contains a side chain comprising 10 to 18 carbon atoms in the alkyl group.

U.S. Pat. No. 2,655,479 of Munday et al is directed to polyester pour depressants and is particularly concerned with average side chain length of acrylate polymer pour depressants. The patent states in column 3, beginning at line 49 that polymers of single esters or homopolymers are not good pour point depressants but that copolymers are generally good pour point depressants. At column 4, beginning at line 44, it is stated that it is necessary that the average side chain length be in the range of about 11.0 to about 13.5 carbon atoms per mol of monomer. However, this patentee uses a combination of only two polymers to obtain this side chain length and the results are unsatisfactory.

U.S. Pat. No. 3,598,737 discloses lubricant compositions which contain copolymers of acrylate esters which are said to improve various characteristics including pour point. This patent states that the average number of carbon atoms should be at least 12.5 to 14.3. These compounds do not appear to be acrylate esters wherein the side chain is this value, but rather this patent shows the use of hydroxyalkyl esters in a poly(methacrylate).

U.S. Pat. No. 3,897,353 discloses oil compositions comprising lubricating oil and a pour depressant which can be an alkylmethacrylate. These acrylates may be made from monomers wherein the alkyl portion of the ester or the side chain has from 12 to 18 carbon atoms and includes mixtures. However, the polymers of this patent are made from nitrogencontaining monomers.

The present invention, however, provides a pour point depressant based on poly(methacrylate) polymeric compositions which represent a narrow class of such compositions and which have advantageous properties in improving the low temperature properties of lubricating compositions while maintaining a good viscosity index.

SUMMARY OF THE INVENTION

It is accordingly one object of the present invention to provide a new and improved pour point depressant composition.

A further object of the invention is to provide a unique and advantageous poly(methacrylate) polymer useful as a pour point depressant in lubricating oils.

A still further object of the present invention is to provide a lubricating oil composition which contains a pour point depressant comprising a poly(methacrylate) polymeric material having an alkyl side chain of critical carbon chain length.

Other objects and advantages of the present invention will become apparent as the description thereof proceeds.

In satisfaction of the foregoing objects and advantages, there is provided by this invention a pour point depressant for lubricating oils which comprises a poly(methacrylate) polymer having the repeating unit

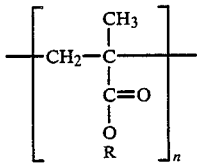

wherein R is an alkyl group having an average chain length in the polymer of 12.6 to 13.0, and n is an integer indicating the number of repeating units, the value of n being sufficient to provide a molecular weight of 30,000 to 220,000 for the polymer, said polymer being a polymer formed from at least three but less than five methacrylate monomers with no individual monomer present in an amount less than 10–15 wt. %.

Also provided by the present invention is a lubricating oil which contains an effective amount of the novel poly(methacrylate) polymer, the effective amount being sufficient to provide an oil which meets the Federal Stable Pour for a 5W-30 lubricating oil.

BRIEF DESCRIPTION OF THE DRAWINGS

Reference is now made to the drawings accompanying the application wherein.

DESCRIPTION OF PREFERRED EMBODIMENTS

Figure 1:
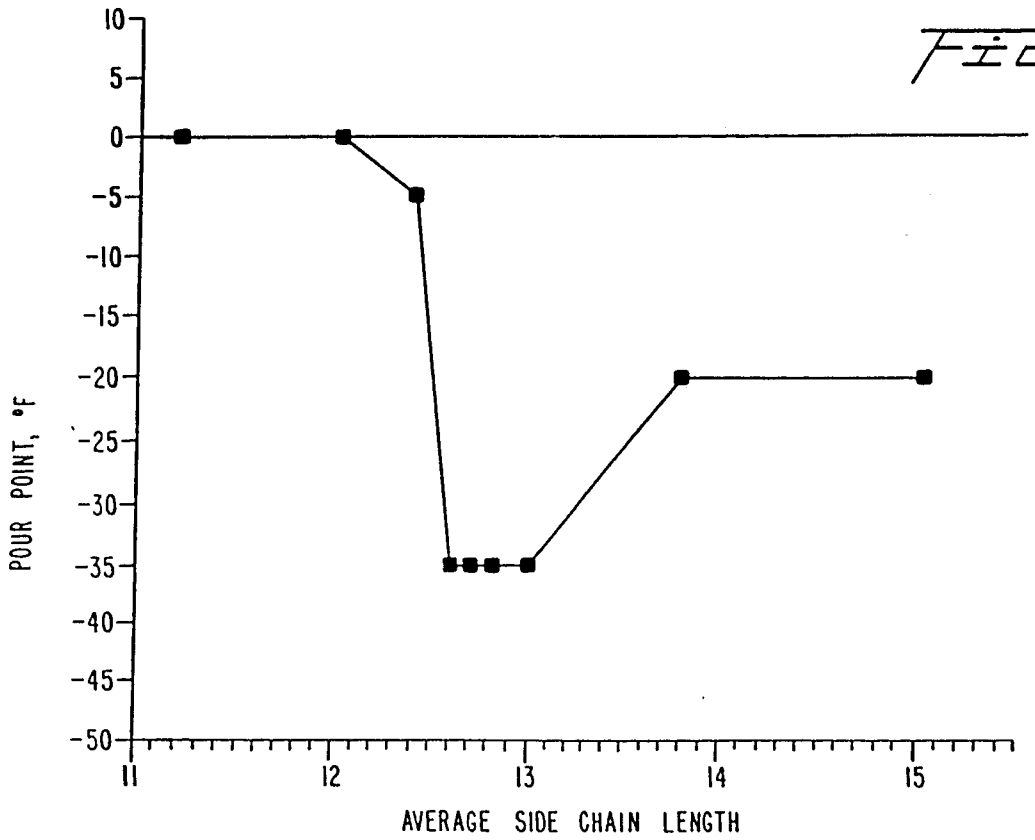
FIG. 1 is a graph showing the pour point effectivness of a polymer of the invention.

As pointed out, above, this invention relates to a new class of pour point depressants and lubricating oils which contain such pour point depressants. The pour point depressants of the present invention comprise a selective group of poly(methacrylate) polymers which have the following repeating unit:

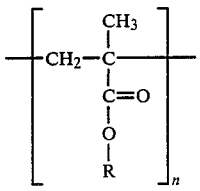

In the above repeating unit, R is an alkyl group having an average carbon chain length in the polymer of 12.6 to 13.0 and n is an integer indicating the number of repeating units, the value of n being sufficient to provide a molecular weight of 10,000 to 300,000 preferably 30,000 to 220,000 for the polymer, the polymer having been prepared from at least three but less than five methacrylate monomers in the $C_{10}$ to $C_{16}$ range with no individual monomer present in an amount less than 10–15 wt. %.

It has been found according to the present invention that for a polymethacrylate to be effective as a pour point depressant in a lubricating oil, it must have an average side carbon chain length of 12.6 to 13.0 carbon atoms. When a polymethacrylate pour point depressant of this type is used in conjunction with a compatible viscosity index improver, a lubricating oil of the 5W-30 quality can be produced to provide a formulation which will pass the required low temperature tests for such oils.

It has been found that whether the formulation will pass or fail the low temperature limits for a 5W-30 lubricating oil formulation will depend, in large measure, on the number and kind of side chains present in the pour point depressant. A successful 5W-30 formulation is defined as one with a Federal Stable Pour of $\leqq -35°$ C., a viscosity of $\leqq$3,500 cP at $-25°$ C. in the Cold Cranking Simulator (CCS), and a MRV (minirotary viscometer) viscosity of $\leqq$30,000 cP at $-30°$ in both the 18 hour (D-3829) and TP-1 cooling cycles. A complete discussion of the low temperature rheology of multi-grade engine oils may be found in the publication by Clevenger et al, Document 831716 of the Society of Automotive Engineers, 1983. This publication sets forth the specifications for various grades of engine oils, particularly as may be seen in Table 1 on page 2 of the publication.

In this application, the reference to average side carbon chain length refers to the length of the carbon chain (R in the formula) in the alkyl group on the ester moiety. The carbon chain length is determined by the alcohol used to esterify the methacrylic acid in preparation of the methacrylate monomer.

In this invention it has been discovered that the identity and number of the ester side chains present in the pour point depressant determines the effectiveness of the formulation as measured by the above tests. According to this invention, it has been found that only certain specific combinations of average side chain alkyl length provide acceptable results.

In this invention it has been discovered that the average side chain length (R) of a poly(methacrylate) pour point depressant must be in the range of 12.6 to 13.0. This average side chain length of the polymer has been found to depress the pour point of a suitable lubricating oil from 0° to $-35°$ F. Alkyl side chain averages lower than this do not provide acceptable results, and polymers with side chain averages larger than 13.0 only lower the pour point to about $-20°$ F. When the effective alkyl side chain average of 12.6 to 13.0 is used in accordance with this invention, a poly(methacrylate) polymer is provided which is an effective pour point depressant and, when used with a suitable viscosity index improver, provides a pour point depressant combination and engine oil which meets the required standards of the Federal Stable Pour.

The poly(methacrylate) pour point depressants of this invention are described as having an average side chain length of 12.6 to 13.0. This value is obtained by using the correct mix of monomers in preparation of the polymer. The polymer is prepared by preparation of the monomers, mixing and blending properly and then subjecting to polymerization. The appropriate mix to obtain an average side chain in the range of 12.6 to 13.0 carbon atoms requires a mixture of at least three monomers of a mixture of $C_{10}$ to $C_{16}$ monomers but less than five such monomers. These references to side chains refer to the esterified portion of the methacrylate or R in the formula. For example, a formulation of monomers which includes 35–38% of $C_{10}$ monomers, 31–34% $C_{14}$ monomers and 28–34% $C_{16}$ monomers will provide a polymer having an average chain length of 12.68 to 13.0. It is within the scope of the present invention, however, to select any combination of at least three but less than five methacrylate monomers in the $C_{10}$ to $C_{16}$ range, with no monomer present in less than 10–15 wt. % which will provide the final polymethacrylate polymer with an average side chain length, or value of R, of 12.6 to 13.0.

As will be apparent from the structure of the polymer, the variations in the chain length are provided by the alcohol which is used to form the ester monomer of methacrylic acid. Thus, the value of R in the monomer may range from $C_8$ to $C_{20}$, but more preferably from about $C_{10}$ to $C_{16}$. A preferred group of monomers will have the value of R ranging from $C_{10}$ to $C_{16}$. The resulting product is therefore a polymer in which the value of R may range from $C_8$ to $C_{20}$, but wherein the average value or average carbon chain length for R is 12.6 to 13.0 provided that the average is obtained with at least three but less than five monomers in the $C_{10}$ to $C_{16}$ range where the minimum concentration of each monomer is at least 10–15% by weight.

As shown in the examples described hereinafter, the pour point of the base oil alone can be depressed with any combination of chains that will yield a 12.6–13.0 chain average; however, with formulated oils the 3 to 5 monomers in the $C_{10}$ to $C_{16}$ range must be carefully chosen as not all combinations will work with ethylene-propylene viscosity index (VI) improvers. Any synergistic mixture of monomers to produce a polymer having this average side chain length or value of R is considered to be within the scope of the invention.

The monomers and resulting terpolymers may be produced by methods well known to the art described, for example, in U.S. Pat. Nos. 3,598,736, and 4,088,589, the disclosures of which are incorporated herein by reference.

As indicated above, a pour point depressant is used in a lubricating oil or engine oil in order to provide a resulting formulation which will pass the low temperature tests required for such fluids, such as the Federal Stable Pour test. The pour point depressant is often used in combination with a viscosity index improver, of which many different types are available. For example, ethylene/propylene viscosity index improvers are particularly available from Amoco. Other viscosity index improvers sold under the name TLA, which are ethylene-propylene copolymers to which a vinyl pyrrolidone has been grafted to provide dispersing characteristics, may also be used with such formulations. Certain chain combinations of the pour point depressant will function with one or the other VI improvers even though the pour point depressant has the requisite 12.6–13.0 side chain average.

The pour point improvers are normally used with a suitable lubricating fluid or engin oil. A preferred lubricating oil of this type is sold by Pennzoil Company under the tradename Atlas, and particularly Atlas 100N. Other base stocks such as, but not limited to, Ashland 100N or Exxon 100 LP are also suitable for use.

As a result of Applicants' research in this area, it has been discovered that an effective pour point depressant will have an average side chain length of 12.6 to 13.0, and this will depress the pour point of a lubricating fluid such as Atlas 100N from 0° down to $-35°$ F. Where the value of R or the side chain length is lower than 12.6, a pour point depressant is provided which is not effective to meet industry standards. Polymers with side chain averages higher than 13.0 will lower the pour point only to about −20° F. To achieve the effective side chain average of 12.6 to 13.0, the polymers are formed from a group of indicated monomer components to provide the best results.

There is also a requirement that the molecular weight of the polymer of the invention have a lower limit of about 30,000 dalton and an upper limit in the range of 220,000 dalton. Thus the degree of polymerization is also important.

The amount of pour point depressant of this invention to be added to the lubricating oil will range from 0.001 to 1.0 wt. % preferably range from about 0.01 to 0.50 wt. % when the pour point depressant is a concentrate. The amount of viscosity index improver added is preferbly about 5 to 20 wt. %.

Reference is now made to the drawings accompanying the application, wherein FIG. 1 is a graph illustrating the pour point of the lubricating fluid Atlas 100N as the pour point changes depending on the average side chain length or the number of carbons for the value of R. As will be noted from FIG. 1, the pour point is at −35° F., which is the value necessary only when the average side chain length ranges from about 12.6 to 13.0.

Figure 2:
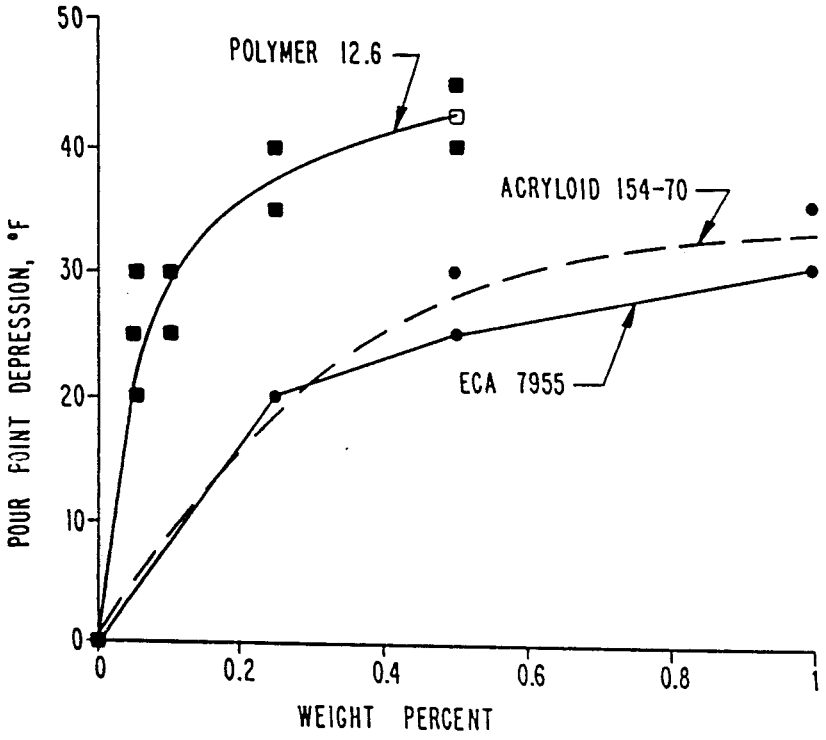
FIG. 2 is a graph comparing a pour point polymer of the invention with commercial products.

In FIG. 2, there is a comparison of the pour point depression in degrees F of the lubricant Atlas 100N containing a polymer of this invention in comparison with commercial polymers Acryloid 154-70 and ECA 7955 based on concentration. It will be seen that the polymer of this invention, indicated as Polymer 12.6, the 12.6 indicating the average chain length or value of R, shows substantially greater pour point depression than Acryloid 154-70 or ECA 7955.

Figure 3:
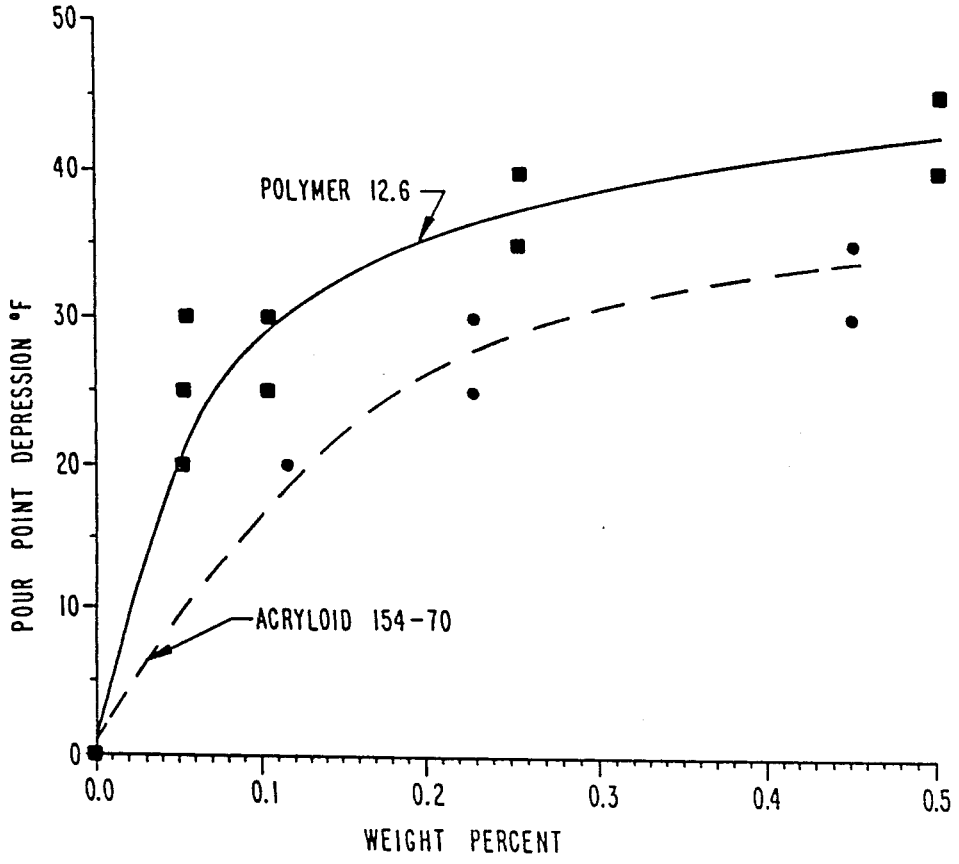
FIG. 3 is a graph similar to FIG. 2 but with correction of a concentration of a commercial product.

FIG. 3 illustrates the pour point of the lubricant Atlas 100N containing Polymer 12.6 in comparison with Acryloid 154-70 with respect to pour point depression versus weight percent concentration of the depressant but wherein the Acryloid 154-70 has had its concentration corrected to account for the diluent oil.

Figure 4:
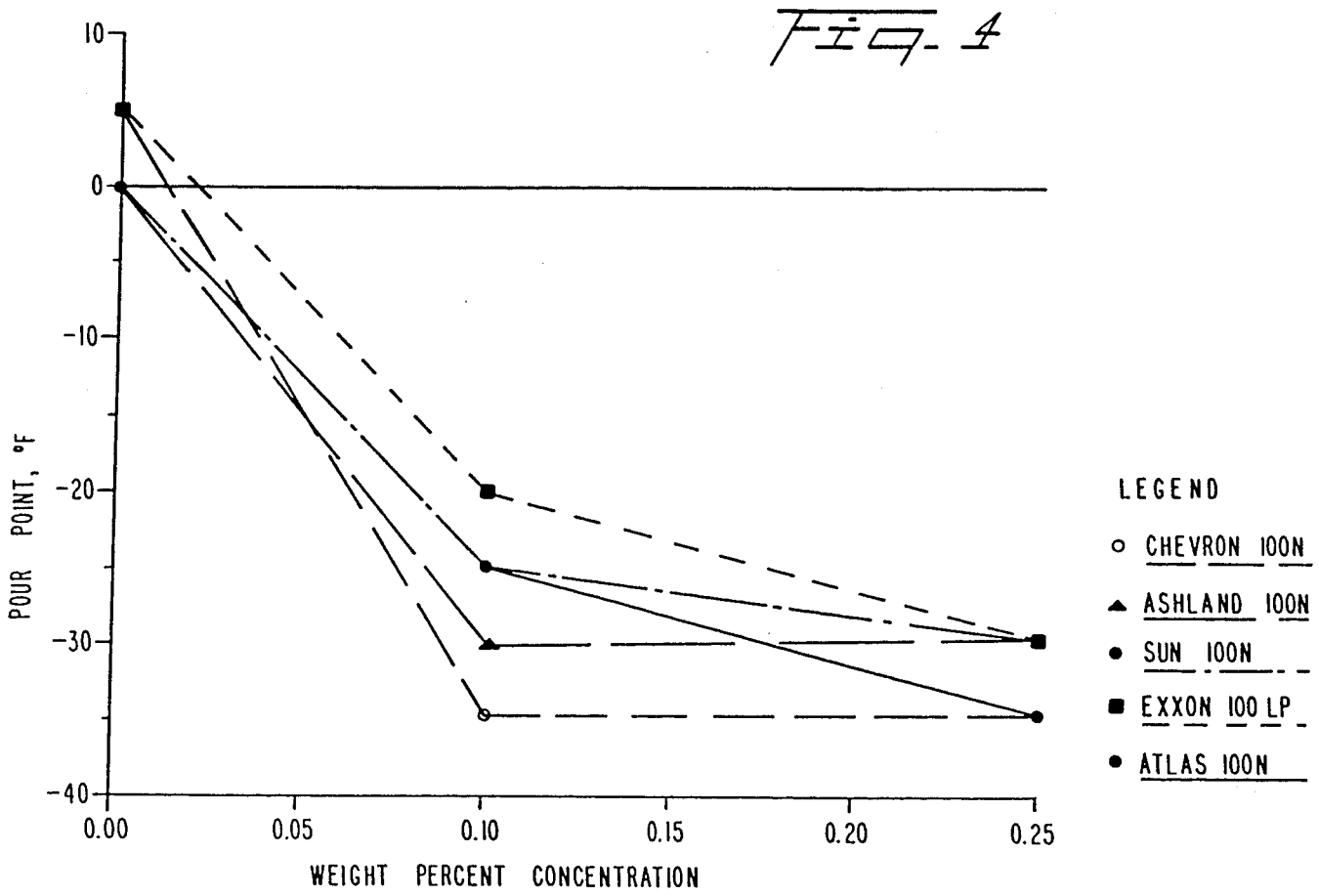
FIG. 4 is a graph showing the pour point effectiveness of a polymer of the invention in different base stocks.

FIG. 4 displays the activity of polymer 12.6 in different base stocks. At 0.25 wt. %, the base stocks have pour points of −30° to −35° F., indicating the pour point depressant activity is not limited solely to Atlas 100N.

The following examples are presented to illustrate the invention, but the invention is not to be considered as limited thereto. In the examples and throughout the specification, parts are by weight unless otherwise indicated.

EXAMPLE 1

In the following Table 1, the polymethacrylate polymer compositions set forth in Experiments 1–13 were prepared using the monomers indicated as $C_4$, $C_{10}$, $C_{11}$, $C_{12}$, $C_{14}$ and $C_{16}$. Thus, the polymers were produced using a combination of methacrylic acid esters wherein the alcohol used to esterify the methacrylic acid had the indicated C value. For example, in Experiment 1, the polymer was prepared from a mixture of three monomers, 45.1% $C_{10}$, 43.1% $C_{12}$ and 11.8% $C_{14}$ for a chain length average of 11.2. In the polymers described in the table, the chain length distribution (normalized weight distribution) was determined by gas chromatography on an SE-30 column of the methacrylate monomer mixture prior to polymerization. In one example, the monomer mixtures was isolated after polymerization, and the composition was nearly the same as the initial change. Polymerizations were conducted in xylene under a nitrogen atmosphere with benzoyl peroxide as the free radical initiator. Reactions were conducted at 85°–95° C. for a period of several hours. Molecular weights were measured by gel permeation chromatography, relative to polystyrene.

The neat polymers were dissolved at 0.25 wt. % in the lube oil Atlas 100N. The pour points were determined by the D-97 test. The results are also displayed in Table 1. A graph of the pour point of Atlas 100N as a function of the average side chain length of the polymethacrylate) PPD is shown in FIG. 1.

TABLE 1

| | Poly (methacrylate) compositions[a] and Pour Points of Atlas 100N[b] | | | | | | | | | |
|---|---|---|---|---|---|---|---|---|---|---|
| | | | | | | | | Molecular Weight | | Pour Point |
| Polymer | $C_4$ | $C_{10}$ | $C_{11}$ | $C_{12}$ | $C_{14}$ | $C_{16}$ | Cav | $\overline{M}w$ | $\overline{M}n$ | (°F.) |
| 1 | — | 45.1 | — | 43.1 | 11.8 | — | 11.2 | 22,800 | 8,200 | 0 |
| 2 | — | — | — | 100 | — | — | 12.0 | 54,400 | 15,500 | 0 |
| 3 | — | — | — | 79.5 | 20.5 | — | 12.4 | 57,100 | 12,200 | −5 |
| 4 | — | — | — | 67.6 | 26.6 | 5.0 | 12.6 | 63,500 | 17,200 | −35 |
| 5 | — | — | 46.7 | — | 36.4 | 16.9 | 12.7 | 56,200 | 12,500 | −35 |
| 6 | — | — | 49 | — | 35 | 16 | 12.7 | 34,000 | 5,100 | −35 |
| 7 | 13 | — | 43 | — | 31 | 14 | 12.7 | 30,500 | 4,000 | −35 |
| 8 | — | — | — | 61.7 | 32.0 | 6.0 | 12.8 | 57,000 | 13,500 | −35 |
| 9 | — | — | — | 60 | 40 | — | 12.8 | 57,000 | 13,500 | −35 |
| 10 | — | 35.1 | — | — | 31.45 | 33.4 | 13.0 | 39,900 | 11,700 | −35 |
| 11 | — | — | — | 39.9 | 30.1 | 30.0 | 13.8 | 31,600 | 11,900 | −20 |
| 12 | — | — | — | 8.8 | 27.4 | 63.7 | 15.0 | 27,000 | 9,000 | −20 |
| 13 | — | — | — | 61.7 | 31.9 | 6.0 | 12.8 | 4,300 | 2,100 | 0 |

[a]normalized weight distribution
[b]concentration is 0.25 Wt. %.

Analysis of the data of Table 1 reveals the following conclusions:

(1) An average side chain length of 12.6–13.0 will depress the pour point of a lube oil of this type from 0° to −35° F. Side chain averages lower than this, Polymers 1–3, do not work; polymers with side chain averages larger than this range, Polymers 11 and 12, only lower the pour point to −20° F.

(2) Within the effective side chain average of 12.6–13.0, polymers with two components (Polymer 9) work as well as polymers with 3 components (polymer 8). A variety of 3 component chains work, (e.g., Polymers 4, 5 or 10).

(3) There is a lower limit on the Mw that a polymer needs to function. Polymer 13 has a Mw of 4300 but does not work while polymer 6 functions with a Mw of 34,000. A Mw of about 30,000 is considered a reasonable lower limit.

(4) There is no difference in effectiveness of the pour point depressants once the lower limit has been reacted. Polymers 5 and 6 are equally effective even though Polymer 5 has Mw of 56,200 and Polymer 6 has an Mw of 34,000.

(5) The effectiveness of Polymer 7 in the lube oil indicates that short chain groups may be present on the polymer but will not interfere with the polymer's effectiveness so long as the average is within the range 12.6–13.0.

EXAMPLE 2

These pour point depressants also compare favorably with commercially available products such as ECA 7955 or Acryloid 154-70. ECA 7955, available from Paramins, is a fumarate or vinyl acetate/fumarate copolymer with Mw=35,000, and Mn=12,000. Acryloid 154-70 is poly(methacrylate) oil concentrate commercially available from Rohm and Haas. The poly(methacrylate) has Mw of 78,000 and Mn=33,700. The polymer was isolated from the oil by repeated precipitation from methanol. The oil free polymer as then subjected to pyrolysis GC mass spectrometry. The normalize chain distribution 18% $C_{12}$, 21% $C_{13}$, 21% $C_{14}$, 16% $C_{15}$, 15% $C_{16}$ and 8% $C_{18}$ with Cav ~14.

Atlas 100N was blended with several different concentrations of Polymer 4 (Table 1), ECA 7955 or Acryloid 154-70. The pour points are depicted graphically in FIG. 2. The graph is somewhat misleading because the commercial pour point depressants are sold as concentrates so that the actual polymer concentration is less than what is displayed. The MS-DS for Acryloid 154-70 states that the concentrate is 40–45 wt. % polymer. FIG. 3 shows the Atlas 100N pour points with the corrected concentration shown for Acryloid 154-70. Polymer 4 depresses the pour better and to a lower overall level than does Acryloid 154-70.

EXAMPLE 3

In this example, several of the poly(methacrylates) described in Table 1, together with several additional polymethacrylates which had the desired average side chain length of 12.6 to 13.0 carbon atoms, were prepared for testing. The composition and molecular weight distribution of this latter group of polymethacrylate pour point depressants is described in Table 2. Table 2 illustrates how polymethacrylate pour point depressants within the scope of the invention can be prepared using different combinations of monomeric components. Thus, the monomers were methacrylates wherein the esterifying alcohol had a carbon chain ranging from 10 carbons to 16 carbons, so that the average carbon chain length for the polymers ranged from 12.68 to 12.85. Table 2 is as follows:

TABLE 2

| Polymer | Polymethacrylate Pour Point Depressants | | | | | | | |
|---|---|---|---|---|---|---|---|---|
| | | | | | | | Molecular Weight | |
| | $C_{10}$ | $C_{11}$ | $C_{12}$ | $C_{14}$ | $C_{16}$ | Cav | $\overline{Mw}$ | $\overline{Mn}$ |
| 14 | 38.8 | — | — | 32 | 28 | 12.68 | 68,000 | 13,300 |
| 15 | — | 33 | 27 | 21.8 | 18.9 | 12.70 | 47,800 | 11,400 |
| 16 | 24.2 | — | 24.4 | 25.7 | 25.3 | 12.8 | 40.600 | 12,200 |
| 17 | 22 | 24 | — | 26 | 29 | 12.75 | 37,500 | 11,600 |
| 18 | 16 | 18 | 20 | 21.8 | 24.1 | 12.85 | 49,800 | 13,500 |
| 19 | 35.8 | — | — | 33.8 | 30.3 | 12.83 | 139,000 | 30,000 |
| 20 | 36.33 | — | — | 35.25 | 28.42 | 12.80 | 195,700 | 65,300 |

EXAMPLE 4

In this example of a formulation study with Viscosity Index Improvers and other additives, formulations are prepared to represent a motor oil having the proper components to meet the Federal Stable Pour, the MRV test, the CCS, the TP-1 cooling cycles. In Table 3, the heading for PPD Polymer refers to the numbered polymer prepared in Tables 1 and/or 2. The VI improver A is an olefin copolymer of ethylene-propylene to which vinyl pyrrolidone has been grafted to give dispersing characteristics. It has a molecular weight of about 180,000. Atlas 100N is the base oil to which these components are added in the amounts indicated.

In this example, two dispersant olefin copolymers Viscosity Index improvers were used in the formulations. VI improver A has a Mw of 189,000 and Mn of 43,000. VI improver B has a bimodel molecular weight distribution. The lower fraction has a Mw of 189,000 and Mn of 76,750. The higher fraction has an Mw > of 1,000,000.

Many of the poly(methacrylates) described in Table 1, along with several additional polymethacrylates that had the desired average side chain length of 12.6–13.0 carbon atoms, were tested in the formulations. The composition and molecular weight distribution of this latter group of poly(methacrylate) PPDs is described in Table 2.

Polymers 19 and 20 were prepared in Atlas 100N and used as concentrates with an effective polymer concentration of 25–35% wt. The Viscosity Index Improver A with their D-97 pour points, Federal Stable Pour, −25° C. CCS viscosities, the CCS, the −30° C. viscosity as measured in the MRV with an 18 hour (D 3829) and TP-1 cooling cycles, and 100° C. viscosities are displayed in Table 3. The results of the Viscosity Index Improver B formulations are shown in Table 4.

Both series of formulations used detergent package A. Detergent package A consists of a borated succinate ester dispersant with a mixture of calcium and magnesium phenates used as detergents. Other detergent packages were used (see below); detergent packages B was composed of a polyisobutylene succinimide dispersant with a magnesium sulfonate detergent; detergent package C contained a polyisobutylene succinimide dispersant with a calcium sulfonate detergent; detergent package D contained only a calcium sulfonate detergent and detergent package E, which has similar constituents as detergent package A but with less calcium phenate. Detergent packages C and D were used together. All detergent packages contained zinc dialkyldithiophosphates. Detergent packages are items of commerce with varied ingredients and methods of preparation, some of which are trade secrets, such that the exact nature or number of components cannot be readily determined. Consequently the above description of the detergent packages is qualitative and is not exhaustive.

Olefin Copolymer VI Improver A Formulations

Formulations 4A, 5B, 10A, 10B, 12A and 12B met the following low temperature standards for a 5W-30 oil; a CCS viscosity of ≦3,500 cP at −25° C., a Federal Stable Pour of ≦−35° C., and a MRV viscosity of ≦30,000 cP at −30° C. with the D-3829 and TP-1 cooling cycles.

Formulations 4A, 5B, 10A, 10B, 12A and 12B used polymers with chain compositions that were 35–38% $C_{10}$, 31–34% $C_{14}$, and 28–34% $C_{16}$ with a side chain average of 12.68–13.0. The polymers are identical except for the molecular weight. Polymer 10, used in formulations 4A–C, has Mw of 39,900 and Mn of 11,700. Polymer 14, used in formulations 5A–B, has a Mw of 68,000 and Mn of 13,300. Polymer 19, used in formulations 10A and 10B has a Mw of 139,000 and Mn of 30,000. Polymer 20 had a Mw of 195,700 and a Mn of 65,300. While all of the polymers will produce successful formulations, higher concentrations of Polymer 10 (Formulations 4A–C) and 14 (Formulations 5A–B) must be used as compared to Polymer 19 (Formulations 10A–B) or Polymer 20 (Formulations 12A and 12B) to get these results. Polymers 10 and 14 were used neat while Polymers 19 and 20 were used as concentrates. The actual amount of Polymer 19 used in formulation 13A is approximately 0.07 to 0.10 wt. %. Polymer 20, used in Formulations 12A and 12B, yielded results similar to those of Polymer 19. The higher molecular weight (Mw) polymers are more effective on the basis of concentration.

The only other effective pour point depressant was Polymer 17 used in formulation 8. It was the only four component pour point depressant which produced satisfactory formulations. However, it is not effective with VI Improver B (see below).

The other formulations do not work. Formulations 1 and 3 fail miserably. Formulations 2A, 2B and 6 have unacceptably high MRV (D-3829) viscosities. Formulation 6 also suffers from a high Federal Stable Pour. Formulation 9 has a high Federal Stable Pour although its MRV (D-3829) and TP-1 viscosities are acceptable.

Formulations 2A–B and 7A–7B demonstrates that increasing the pour point depressant concentration can cause a deterioration in the properties of the formulations. The MRV viscosity, with the D-3829 cooling cycle, increases for Polymer 5 in formulations 2A and 2B. The stable pour increased in formulations 7A and 7B when the concentration and Polymer 16 was increased.

Formulations 11A–C use Acryloid 154-70 as the pour point depressant. Formulations 11A and 11B have stable pour problems. The MRV viscosities also increase to unacceptably high levels when the Acryloid 154-70 concentration is increased to 1.0 wt. % (Formulation 11C).

The three component pour point depressant that has a $C_{10}$, $C_{14}$, and $C_{16}$ chain distribution and the four component pour point depressant with the $C_{10}$, $C_{11}$, $C_{14}$ and $C_{16}$ chain length distributions are the best pour point depressants tested. They produce formulations with better low temperature properties than either Acryloid 154-70 or any of the other experimental pour point depressants. For the latter polymers, it is not clear why certain three or four component function in the presence of DOCP VI improvers an other three or four chain combinations do not. It is also not clear why a three component pour point depressant should work better than almost all of the four component pour point depressants and the five component pour point depressants.

Olefin Copolymer VI Improver B Formulations

The low temperature properties of the VI Improver B formulations are displayed in Table 4.

Formulations 2A, 2B, 3, 8 and 12 have acceptable stable pours, CCS viscosities and MRV (D-3829) viscosities. Formulations 2–3 contain Polymers 5 or 6; these polymers contain the same chain distribution, and they differ only in molecular weight. There does not seem to be any difference in overall performance of the formulation due to molecular weight for Polymers 5 or 6. Only Polymer 19 or Polymer 20 (see Table 5) functions effectively with both VI Improper A or VI Improver B. The other polymers work successfully with only one of the VI improvers. Polymer 5 fails with VI Improver A, formulation 2A–B in Table 3, but works effectively with VI Improver B, formulations 2A–B in Table 4. Polymer 17 functions with VI Improver A, formulation 8 in Table 3, but fails with VI Improver B, formulation 10 in Table 4. Polymer 15 functions effectively with VI Improver B, formulation 8, in Table 4, but is not effective with VI Improver A, formulation 6, Table 3. These results indicate that a pour point depressant can be tailored for each DOCP VI improver.

The other formulations have high MRV viscosities in the standard cooling cycle (formulation 7) or with the TP-1 cycle (Formulations 7, 9–11).

Formulation 13 contains Acryloid 154-70. While it has acceptable MRV viscosities in both the D-3829 and TP-1 cooling cycles, the stable pour is too high. The experimental pour point depressants described in Tables 1 and 2 produce better 5W-30 formulations.

The failure of Polymer 7 in formulation 4 is an interesting contrast to the success of Polymer 6 in Formulation 3. The only difference between the two pour point depressant polymers is that Polymer 7 contains butyl groups. The butyl groups may be interfering with the success of the formulation.

Miscellaneous Formulations

Various VI/DI package combinations were tested with polymers 19 or 20 in Atlas 100N as potential 5W-30 formulations. The low-temperature viscometric properties of the formulations are displayed in Table 5. Both pour point depressant concentrates, polymers 19 and 20, function effectively with a variety of VI/DI package combinations, producing formulations with very good low-temperature properties. The poly (methacrylate) with a $C_{10}$, $C_{14}$, and $C_{16}$ chain distribution with a $C_{av}$ of 12.6–13.0 is a versatile pour point depressant.

Several 10W-30 and 10W-40 formulations were tested with Polymer 20 in Atlas or Chevron base stocks. The low-temperature results of the formulations are collated in Table 7. The 10W series is required to have $\leqq -30°$ C. Federal Stable Pour, a CCS viscosity of $\leqq 3500$ cP at $-20°$ C., and a viscosity of $\leqq 30{,}000$ cP at $-25°$ C. in both the 18-hour and TP-1 cooling cycles. The formulations with Polymer 20 quite easily surpassed these requirements. The fact that the pour point depressant functions in 5W-30s, 10W-30s, and 10W-40s makes it an attractive, versatile additive.

The pour point depressant, Polymer 19, was tested in Ashland 100N with very good results shown in Table 7. The 5W-30 formulations had very good lowtemperature properties, indicating that the pour point depressant is not limited to only one base stock.

In conclusion, eleven poly(methacrylates) with an effective side chain length of 12.6–13.0 carbon atoms were effective pour point depressants in Atlas 100N as long as no other additives were present. When the pour point depressants were tested in formulations with a detergent package and a DOCP VI Improver, only one of the eleven pour point depressants was compatible with the two DOCP VI Improvers. This unique pour point depressant has a specific combination of three chain lengths, $C_{10}$, $C_{14}$ and $C_{16}$. Pour point depressants with two, four or five chains will produce formulations with compatibility problems, poor low temperature properties, or will be successful with only one of the DOCP VI improvers. Three component pour point depressants that do not have $C_{10}$, $C_{14}$ and $C_{16}$ will also produce problem formulations.

TABLE 3

| Formulation | PPD Polymer | PPD % | DI A | VI A | Atlas 100N | Pour Point °F. | Stable Pour, °C. | CCS, cP −25° C. | MRV, cP −30° C. | TP-1 cP, −30° C. | Vis 40° C., 100° C. VI |
|---|---|---|---|---|---|---|---|---|---|---|---|
| | | | | Formulations with Olefin Copolymer VI Improver A | | | | | | | |
| 1 | 4 | 0.25 | 8.95 | 10.5 | 80.30 | −5 | — | 3700 | Frozen | — | 69.13, 11.53, 162 |
| 2A | 5 | 0.25 | 8.96 | 10.57 | 80.22 | −30 | — | 2656 | 40384 | — | 70.03, 11.67, 162 |
| 2B | 5 | 0.42 | 8.86 | 10.97 | 79.75 | −35 | — | 3225 | 46080 | — | 73.12, 12.18, 164 |
| 3 | 9 | 0.38 | 8.69 | 10.56 | 80.37 | −5 | — | — | — | — | 69.54, 11.66, 163 |
| 4A | 10 | 0.44 | 9.1 | 10.52 | 79.94 | −35 | −38 | 3150 | 25616 | 23201 | 71.00, 11.87, 167 |
| 4B | 10 | 0.25 | 9.03 | 10.52 | 80.70 | −30 | −32 | 3425 | 25533 | 24416 | 70.26, 11.62, 160 |
| 4C | 10 | 0.1 | 9.10 | 10.46 | 80.34 | −30 | −32 | 3350 | 23772 | 25085 | 69.49, 11.49, 160 |
| 5A | 14 | 0.265 | 9.02 | 10.50 | 80.21 | −32 | −32 | 3175 | 24746 | 24678 | 70.46, 11.69, 162 |
| 5B | 14 | 0.35 | 9.05 | 10.51 | 80.09 | −39[a] | −41 | 3250 | 24107 | 20308 | 71.05, 11.87, 164 |
| 6 | 15 | 0.25 | 9.06 | 10.54 | 80.15 | −30 | −20 | 3350 | 43251 | 68690 | 70.66, 11.66, 160 |
| 7A | 16 | 0.25 | 9.21 | 10.37 | 80.17 | −30 | −32 | 3400 | 23735 | 23849 | 69.56, 11.53, 160 |
| 7B | 16 | 0.39 | 9.06 | 10.60 | 9.95 | −39[a] | −23 | 3250 | 24802 | 19119 | 89.98, 11.74, 164 |
| 8 | 17 | 0.25 | 9.48 | 10.52 | 79.75 | −30 | −35 | 3450 | 24605 | 25297 | 70.98, 11.73, 161 |
| 9 | 18 | 0.249 | 8.77 | 10.27 | 80.71 | −30 | −20 | 3325 | 21825 | 21870 | 68.47, 11.44, 162 |
| 10A | 19 | 0.24[b] | 9.15 | 10.56 | 80.05 | −33[a] | −38 | 3325<br>25 | 22663<br>81 | 20802 | 69.58, 11.65, 163 |
| 10B | 19 | 0.59[b] | 9.03 | 10.51 | 79.87 | −25 | −38 | 3225 | 26690<br>(yield stress 35) | 20,145 ±<br>13 | 70.63, 11.82, 164 |
| 11A | Acryloid 154-70 | 0.28 | 9.14 | 10.53 | 80.05 | −25 | −32 | 3400 | 24391 | 25379 | 69.49, 11.59, 162 |
| 11B | Acryloid 154-70 | 0.52 | 9.00 | 10.01 | 79.87 | −30 | −32 | 3350 | 25724 | 24997 | 70.70, 11.76, 162 |
| 11C | Acryloid 154-70 | 1.0 | 9.26 | 10.54 | 79.2 | −25 | — | 3600 | 29146 | 27681<br>589 | 77.29, 12.04, 164 |
| 12A | 20 | 0.25[b] | 9.17 | 10.58 | 80.0 | — | −38 | 3250 | 18682 | 21412 | 70.25, 11.82, 161 |
| 12B | 20 | 0.37[b] | 9.28 | 10.48 | 79.87 | — | −38 | 3100 | 18804 | 21842 | 70.51, 11.81, 164 |

[a]in °C.
[b]concentrate

TABLE 4

| Formulation | PPD Polymer | PPD % | DI A | DI B | Altas 100N | Pour Point, °F. | Stable Pour, °C. | CCS, cP −25° C. | MRV, cP −30° C. | TP-1 cP, −30° C. | Vis 40° C., 100° C., VI |
|---|---|---|---|---|---|---|---|---|---|---|---|
| | | | | | | Olefin Copolymer VI Improver B | | | | | |
| 1 | 4 | 0.27 | 8.97 | 15.98 | 74.78 | −30 | — | 2925 | Frozen | — | 83.25, 13.58, 167 |
| 2A | 5 | 0.247 | 9.07 | 13.9 | 76.77 | −30 | −38 | 2894 | 21880 | — | 73.3, 11.82, 157 |
| 2B | 5 | 0.41 | 9.07 | 13.91 | 76.67 | −35 | −38 | 2854 | 18681 | — | 73.13, 12.07, 162 |
| 3 | 6 | 0.248 | 9.13 | 13.84 | 76.78 | −30 | −38 | 3225 | 20510 | 20282 | 71.3, 11.77, 159 |
| 4 | 7 | 0.252 | 9.05 | 13.83 | 76.89 | −25 | — | — | >1,060,000 | — | 71.34, 11.79, 161 |
| 5 | 8 | 0.25 | 8.94 | 14.15 | 76.67 | −25 | — | 2850 | Frozen | — | 73.31, 11.86, 157 |
| 6A | 10 | 0.1 | 9.03 | 13.99 | 76.88 | −35 | — | 3000 | 24375 | 30829 | 72.61, 11.75, 157 |
| 6B | 10 | 0.25 | 9.30 | 13.90 | 76.55 | −30 | — | 3225 | 25931 | 26171 | 72.16, 11.75, 158 |
| 6C | 10 | 0.44 | 9.02 | 14.00 | 76.54 | −35 | — | 3350 | 26403<br>yield stress 35 | 17902 | 73.84, 12.14, 162 |
| 7 | 14 | 0.248 | 9.01 | 13.75 | 76.99 | −30 | — | 2950 | 26600 | 28860 | 72.02, 11.78, 159 |
| 8 | 15 | 0.25 | 9.02 | 13.73 | 77.00 | −30 | −35 | — | 22345 | 21417 | 71.00, 11.59, 158 |
| 9 | 16 | 0.249 | 9.10 | 13.67 | 76.98 | −40 | — | 3275 | 24755 | 27394 | 71.20, 11.59, 158 |
| 10 | 17 | 0.25 | 9.05 | 13.86 | 76.84 | −30 | — | 3000 | 26919 | 29298 | 71.95, 11.74, 159 |
| | | | | VI B | | | | | | | |
| 11 | 18 | 0.25 | 8.93 | 15.35 | 75.45 | −35 | — | 3350 | 29469 | 27325 | 78.55, 12.65, 160 |
| 12 | 19 | 0.66[a] | 9.01 | 13.63 | 76.70 | −30 | −35 | 2900 | 26889 | 23663 ± | 72.35, 11.89, 161 |
| 13 | Acryloid 154-70 | 0.27[a] | 8.98 | 13.55 | 77.20 | −25 | −32 | 3250 | 22655 | — | 70.00, 11.40, 156 |

[a]concentrate

TABLE 5

| PPD | % PPD | DI, % | VI, % | Stable Pour, °C. | −MRV, −30° C. | TP-1 −30° C. | CCS, −25° C. | Vis 40, VI 100° C. |
|---|---|---|---|---|---|---|---|---|
| | | Pour Point Depressant Performance with different DI/VI package combinations. Concentration in weight percent. Basestock is Atlas 100N. | | | | | | |
| 19 | 0.26 | B, 8.48 | A, 10.66 | −38 | 17041 | 18894 | 3205 | 68.15, 11.47<br>103 |
| 19 | 0.21 | C, 7.05<br>D, 1.2 | A, 10.59 | −38 | 14957 | 16691 | 2925 | 65.02, 11.07<br>163 |

TABLE 5-continued

Pour Point Depressant Performance with different DI/VI package combinations. Concentration in weight percent. Basestock is Atlas 100N.

| PPD | % PPD | DI, % | VI, % | Stable Pour, °C. | −MRV, −30° C. | TP-1 −30° C. | CCS, −25° C. | Vis 40, VI 100° C. |
|---|---|---|---|---|---|---|---|---|
| 20 | 0.24 | C, 6.85<br>D, 1.08 | B, 15.57 | −38 | 16203 | 20172 | 3000 | 73.34, 11.99<br>160 |
| ECA 7955 | 0.5 | C, 6.85<br>D, 1.08 | B, 15.57 | −29 | 25616 | 27953 | 2800 | 69.34, 11.25<br>159 |

TABLE 6

Pour Point Depressant Performance in 10W30s and 10W40s with selected basestocks. Polymer 20, Table 2, was used as the pour point depressant.

| % PPD | Basestocks | VI, % | DI, % | MRV, −25° C. | TP-1 −25° C. | CCS, −20° C. | Stable Pour, °C. | Vis 100° C. |
|---|---|---|---|---|---|---|---|---|
| 0.22 | Atlas 100N, 300N[a] | A, 7.72 | E, 7.54 | 11993 | 12756 | 3075 | −44 | 11.51 |
| 0.249 | Atlas 100N, 300N[b] | A, 12.49 | E, 7.46 | 16361 | 16634 | 3025 | −39 | 15.60 |
| 0.38 | Chevron 100N, 240N[a] | A, 6.88 | E, 7.97 | 9196 | 13882<br>(Yield stress 35) | 2450 | ≦41 | 10.49 |

[a]10W30
[b]10W40

TABLE 7

Pour Point Depressant Performance in Ashland 100N 5W-30 Formulation Polymer 19, Table 2 is the pour point depressant. Concentration is in weight percent

| PPD | VI | DI | MRV, −30° C. | TP-1, −30° C. | CCS, −25° C. | Stable Pour, °C. |
|---|---|---|---|---|---|---|
| 0.27 | 14.52 VI improver B | 7.0, Package C<br>0.99 Package D | 15023 | 17099 | 2675 | −41 |
| 0.258 | 14.52 VI improver B | 8.51 Package B | 15344 | 18641 | 2850 | −44 |
| 0.26 | 10.61 VI improver A | 9.07 Package A | 16620 | 19029 | 3000 | −41 |

The invention has been described below with reference to certain preferred embodiments. However, as obvious variations thereon will become apparent to those skilled in the art, the invention is not to be considered as limited thereto.

What is claimed is

1. A pour point depressant for lubricating oils comprising a poly(methacrylate) polymer having the repeating unit

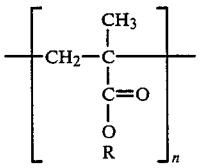

wherein R is an alkyl group having an average chain length in the polymer of 12.6 to 13.0, and n is an integer indicating the number of repeating units, the value of n being sufficient to provide a molecular weight of 10,000 to 30,000 for the polymer, said polymer being a polymer formed from the reaction of at least three but less than five methacrylate monomers with no individual monomer present in an amount of less than 10 wt. %.

2. A pour point depressant according to claim 1 wherein the polymer is prepared by polymerization of at least three but less than five methacrylate monomers of the formula

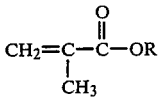

wherein R may range from 8 to 20 carbon atoms.

3. A pour point depressant according to claim 2 wherein the value of R ranges from 10 to 16 carbon atoms.

4. A pour point depressant according to claim 2 wherein at least three but less than five monomers where each monomer is not less than 10–15 wt. % monomers are polymerized wherein the value of R is selected from the group consisting $C_{10}$, $C_{11}$, $C_{12}$, $C_{14}$, and $C_{16}$.

5. A pour point depressant according to claim 4 wherein the polymer is formed from monomer mixtures wherein R is $C_{10}$, $C_{14}$ and $C_{16}$.

6. A pour point depressant according to claim 4 wherein 3 monomers are used where each monomer is not less than 25 wt. % of the polymer wherein the monomers are $C_{10}$, $C_{11}$, $C_{14}$ and $C_{16}$.

7. A lubricating oil composition comprising a wax containing hydrocarbon lubricating oil, said lubricating oil containing a sufficient amount of a pour point depressant to reduce the pour point to −35° F., said pour point depressant comprising an effective amount of a polyalkylmethacrylate having the repeating unit

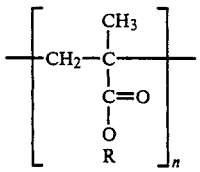

wherein R is an alkyl group having an average chain length in the polymer of 12.6 to 13.0, and n is an integar indicating the number of repeating units, the value of n being sufficient to provide a molecular weight of 10,000 to 300,000 for the polymer, said polymer being a polymer formed from the reaction of at least three but less than five methacrylate monomers with no individual monomer present in an amount of less than 10 wt. %.

8. A lubricating oil composition according to claim 7 wherein the polymer is prepared by polymerization of at least three but less than five monomers where each monomer is present in at least 10–15 wt. % methacrylate monomers of the formula

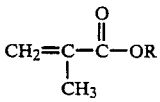

wherein R may range from 10 to 20 carbon atoms.

9. A lubricating oil composition according to claim 7 wherein the value of R ranges from 10 to 16 carbon atoms.

10. A lubricating oil composition according to claim 7 wherein at least three but less than five where each monomer comprises at least 10–15 wt. % of the mixture monomers are polymerized wherein the value of R is selected from the group consisting of $C_{10}$, $C_{11}$, $C_{12}$, $C_{14}$, and $C_{16}$.

11. A lubricating oil composition according to claim 9 wherein the polymer is formed from a mixture of monomers wherein R is $C_{10}$, $C_{14}$ and $C_{16}$ and each monomer comprises at least 25% of the polymer.

12. A lubricating oil composition according to claim 7 which also contains a viscosity index improver.

13. A lubricating oil composition according to claim 12 where the viscosity index improver comprises an ethylene propylene copolymer.

14. A lubricating oil composition according to claim 7 which also contains a detergent.

15. A lubricating oil composition comprising a wax containing hydrocarbon lubricating oil and containing a sufficient amount of a pour point depressant to reduce the pour point to comply with the requirements of a 5W-30 lubricating oil in combination with a viscosity index improver, said pour point component comprising an effective amount of a poly(methacrylate) polymer having the repeating unit

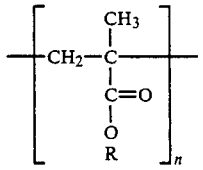

wherein R is an alkyl group having an average chain length in the polymer of 12.6 to 13.0, and n is an integer indicating the number of repeating units, the value of n being sufficient to provide a molecular weight of 10,000 to 300,000 for the polymer, the pour point depressant having been formed by reaction of at least three but less than five methacrylate monomers where each monomer is at least 10 wt. % of the mixture having the formula

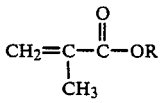

wherein R is selected from the group consisting of $C_{10}$–$C_{16}$ alkyl groups, the value of R being chosen so that the average chain length in the polymer of the R group is 12.60–13.0.

16. A lubricating oil composition according to claim 15 wherein the viscosity index improver comprises an ethylene propylene copolymer.

17. A lubricating oil composition according to claim 15 wherein the pour point depressant is added as a concentrate in an amount of 0.001 to 1.0 wt. %, based on the total amount of lubricating oil.

18. A lubricating oil composition according to claim 16, wherein the viscosity index improver concentrate is present in an amount of 5 to 20 wt. %, based on the amount of lubricating oil.

19. A method for depressing the pour point of a lubricating oil composition which comprises adding to the lubricating oil an effective amount of a poly(methacrylate) polymer having the repeating unit

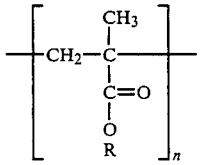

wherein R is an alkyl group having an average chain length in the polymer of 12.6 to 13.0, and n is an integer indicating the number of repeating units, the value of n being sufficient to provide a molecular weight of 10,000 to 300,000 for the polymer, said polymer being a polymer formed from the reaction of at least three but less than five methacrylate monomers with no individual monomer present in an amount of less than 10 wt. %.

20. A method according to claim 19 wherein the polymer is prepared by polymerization of at least but less than five methacrylate monomers of the formula

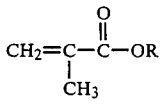

wherein R may range from 8 to 20 carbon atoms.

21. A method according to claim 19 wherein the effective amount of pour point depressant is 0.001 to 1.0 wt. % based on the total amount of lubricating oil.

* * * * *

UNITED STATES PATENT AND TRADEMARK OFFICE

CERTIFICATE OF CORRECTION

PATENT NO. : 4,844,829

DATED : July 4, 1989

INVENTOR(S) : Bruce E. Wilburn et al

It is certified that error appears in the above-identified patent and that said Letters Patent is hereby corrected as shown below:

Column 16, line 62

Claim 6, line 4, delete "$C_{11}$"

Column 16, line 66

Claim 7, line 4, before "pour point" insert --stable--;
line 4, "-35°F." should be -- -35°C.--

Signed and Sealed this

Twenty-first Day of April, 1992

*Attest:*

HARRY F. MANBECK, JR.

*Attesting Officer*

*Commissioner of Patents and Trademarks*